US010600532B1

(12) United States Patent
White et al.

(10) Patent No.: US 10,600,532 B1
(45) Date of Patent: Mar. 24, 2020

(54) SERVICE LOOP FOR TOP DRIVE EQUIPMENT HAVING AN EMBEDDED LAY LINE

(71) Applicant: NEXANS, Courbevoie (FR)

(72) Inventors: Robert White, Houston, TX (US); Michael Hammons, El Dorado, AR (US)

(73) Assignee: NEXANS, Courbevoie (FR)

( * ) Notice: Subject to any disclaimer, the term of this patent is extended or adjusted under 35 U.S.C. 154(b) by 0 days.

(21) Appl. No.: 16/231,779

(22) Filed: Dec. 24, 2018

(51) Int. Cl.
*H01R 4/00* (2006.01)
*H01B 7/04* (2006.01)
*H01B 9/00* (2006.01)
*H01B 7/18* (2006.01)

(52) U.S. Cl.
CPC ..... *H01B 7/046* (2013.01); *H01B 7/183* (2013.01); *H01B 9/003* (2013.01)

(58) Field of Classification Search
USPC ..... 174/110 R, 113 R, 112
See application file for complete search history.

(56) References Cited

U.S. PATENT DOCUMENTS 5,431,759 A * 7/1995 Neuroth ..... H01B 7/046 156/169
5,922,996 A * 7/1999 Ryeczek ..... G01K 11/12 116/207
6,143,988 A * 11/2000 Neuroth ..... E21B 17/1085 174/105 R
6,906,264 B1 * 6/2005 Grant, Jr. ..... H01B 7/366 174/102 D
7,468,489 B2 * 12/2008 Alrutz ..... H01B 7/366 174/112
7,812,259 B2 * 10/2010 Agan ..... H01B 7/368 174/112
9,343,200 B2 * 5/2016 Perez-Sanchez ..... H01B 7/366
2002/0185299 A1 * 12/2002 Giebel ..... G02B 6/4482 174/110 R
2009/0114418 A1 * 5/2009 Smith ..... G09F 3/00 174/112
2009/0188694 A1 * 7/2009 Pereira ..... H02G 3/0468 174/112
2009/0301172 A1 * 12/2009 Raymond ..... G01M 3/165 73/40
2011/0220386 A1 * 9/2011 Temblador ..... G06Q 50/04 174/102 C
2015/0179307 A1 * 6/2015 Ranganathan ..... H01B 7/36 174/113 R

* cited by examiner

*Primary Examiner* — William H. Mayo, III
(74) *Attorney, Agent, or Firm* — Sofer & Haroun, LLP

(57) ABSTRACT

A top drive service loop cable assembly including a plurality of cabled internal cable components a jacket covering the internal cable components, and a flange connected to the jacket and supporting sat internal cable components. The jacket has an embedded lay line embossed into the cable, aligned with internal cable components.

4 Claims, 6 Drawing Sheets

SERVICE LOOP FOR TOP DRIVE EQUIPMENT HAVING AN EMBEDDED LAY LINE

FIELD OF THE INVENTION

The present arrangement relates to top drive service loops. More particularly the present arrangement relates to a top drive service loop with a robust and permanent lay line.

DESCRIPTION OF RELATED ART

A dynamic application cable assembly, as differentiated from a static application cable, is one that is subjected to one or more cyclical or continual forces including bending, twisting, tension, compression, thermal loading, external pressure, and the like.

Examples of such dynamic cable assemblies include top drive service loop cable assemblies for drilling rigs, bridle cable assemblies used on offshore tender vessels, and shuttle car cable assemblies used in mining operations. These large dynamic application cables typically include a combination of electrical wires, hydraulic lines and fiber optic cables. See for example prior art FIG. 1 showing a top drive service loop cable in place on an oil drilling rig.

As an example of the ordinary type of twisting that these dynamic cable assemblies are subject to, there is normally at least one twist located on one side of the turning point, e.g. the lowest point of the loop. And, as the top drive moves up and down, the length of the twisted area can change. As the length shortens the twist would be completed over a much shorter segment of cable thereby increasing the resultant torsional effect. Over time this can result is deformation of the service loop, similar to a twisted phone cord.

As a result, these unitized service loops, sometimes referred to as cable style service loops, are susceptible to damage due to improper installation, in particular when inducing torsional forces.

Regarding the structure of such dynamic service loop assemblies, in some prior art arrangements, the component cables are fitted into a large diameter rubber hose which is often reinforced with steel wires or synthetic fibers. Within this hose there is typically a potting material to support the cable components against the inside diameter of the hose. See for example prior art FIG. 2.

Other newer prior art arrangements for dynamic application cable assemblies include a unitized cable (i.e. components and extruded jacket) along with a connection arrangement that incorporates features that collectively work to support not only the weight of the cable but also the dynamic loads experienced by the cable assembly without the need for the potted hose design. See for example prior art FIG. 3.

Never-the-less, in both cases, owing to the dynamic use of such cable designs there is a lot of repeated exposure to torsional stresses on the jacket/hose and/or the internal components. These stresses are often a result of two major factors, the first is the trapped torsion which is a result of the cabling process. In this context cabling refers to twisting all of the internal cabling components together in a helical or S-Z stranding prior to jacketing (or placement within a hose). This is done to accommodate the cable component length adjustment requirements that are experienced during bending or movement of the cables.

As the individual conductors are twisted together there is an induced torsion as the conductors attempt to return to their natural, untwisted, shape. This induced torsion is "trapped" in various amounts depending on the cable design, but is typically proportional to the size of the individual conductors.

The second factor regarding cable component stress is the additional torsion which is applied if the loop is installed with a "cast." A cast is induced when the connection points on the connectors at the end of the dynamic assembly are rotated in relation to each other. For example, as noted above the internal cable components are somewhat helically disposed and that twist is locked in during installation. There is already a pre-imparted stress on the cable components. Then these large cables are installed in top drive service arrangements. Here the cable can be further twisted when bolting the flanges to the top drive equipment (ie the "cast"). Then, when the dynamic service loop is in operation (e.g. moving up and down) these pre-imparted stresses are compounded by the cast further stressing the cable components and causing the cables to fail even sooner than their normal service life.

To prevent this improper mis-aligned connection aspect of the stress, cable markings are used to create a "lay line" on the jacket which is in-line with the internal components of the top drive service loop cable. The lay line shows the least stress alignment of the cabled internal cable components. If the lay line is straight during and after installation then it is known that the internal components are likewise in a straight and having the least possible pre-tensioned arrangement. This lay line can be monitored overtime to check on the continued de-stressed arrangement during use so that periodic adjustments can be made if needed, such as after prolonged high stress use sessions that may result in a twisted cable.

However, these printed lay lines are easily removed with solvents or covered with dirt. Furthermore, the intermittent nature of such marking, with their usual one meter spacing, limits their use as complete indicator both during installation and thereafter.

OBJECTS AND SUMMARY

The present arrangement overcomes the drawbacks associated with the prior art and provides and embedded lay line for top drive service loop cables.

To this end, a top drive service loop cable assembly includes having a plurality of cabled internal cable components a jacket covering the internal cable components, and a flange connected to the jacket and supporting sat internal cable components. The jacket has an embedded lay line embossed into the cable, aligned with internal cable components.

BRIEF DESCRIPTION OF THE DRAWINGS

The present invention can be best understood through the following description and accompanying drawing, wherein.

DETAILED DESCRIPTION

Figure 1:
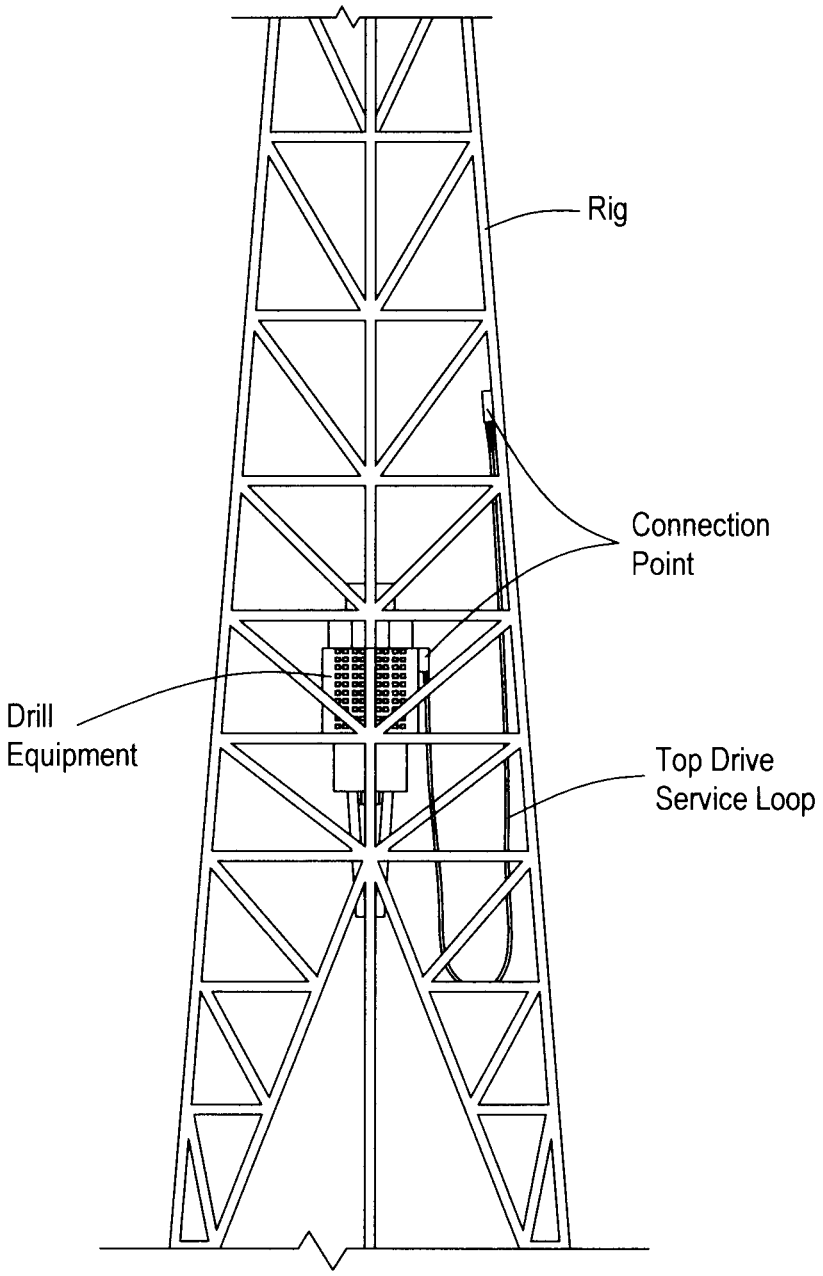
FIG. 1 (Prior Art)
FIG. 1 is a prior art image of a top dive service loop cable assembly installed on a drilling rig.
Figure 2:
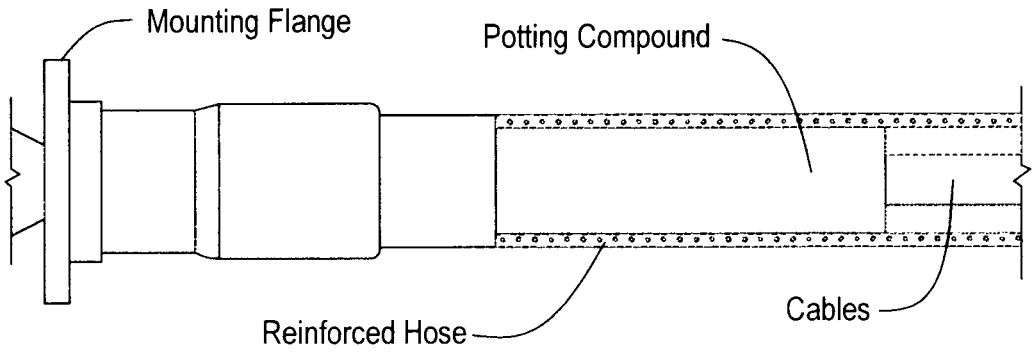
FIG. 2 (Prior Art)
FIG. 2 is a prior art example of a top drive service loop cable assembly in a potted hose.
Figure 3:
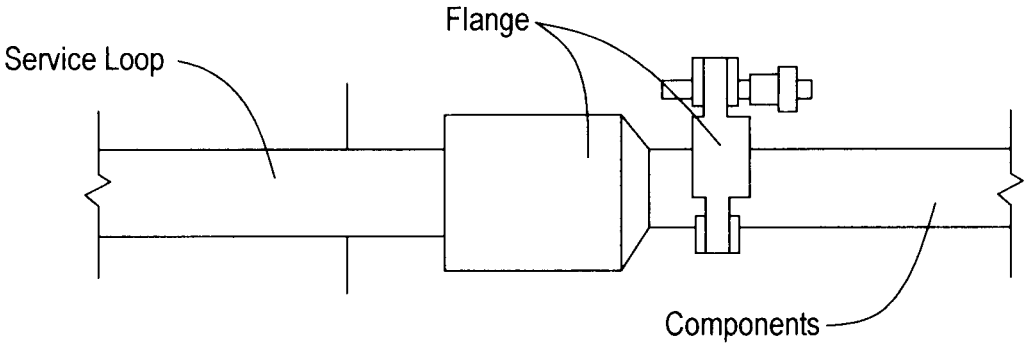
FIG. 3 (Prior Art)
FIG. 3 is a prior art example of a top drive service loop cable assembly in a jacket with flange.
Figure 4:
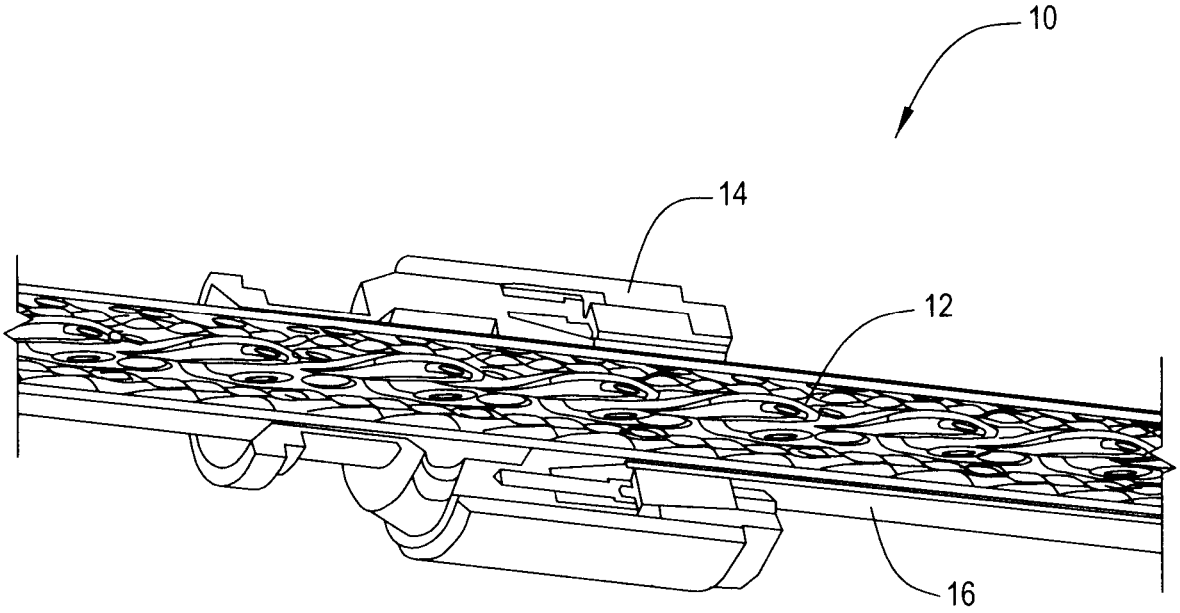
FIG. 4 is a side cross section of a top drive service loop cable assembly in accordance with one embodiment.
Figure 5:
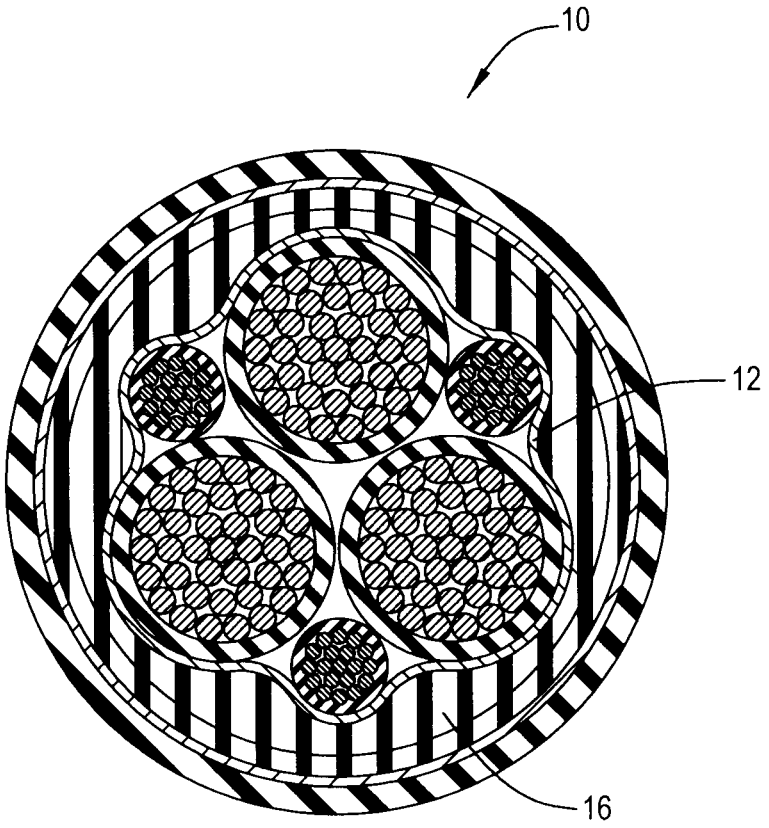
FIG. 5 is a axial cross section of a top drive service loop cable assembly in accordance with one embodiment.

In one embodiment FIGS. 4 and 5 show an exemplary top drive service loop cable assembly 10 in cut away view. This cable assembly includes a plurality of internal cables 12, a mounting flange 14 and a jacket 16. For the purposes of illustration, the present example is in the form of jacketed assembly but the below described features can be used in the potted hose variation as well.

As noted above, the plurality of internal cable components 12 are cabled together in a helical or S-Z stranded arrangement. These cable components 12 are twisted at a given rate depending on the cable design (lay length). This initial basic twist is considered to be the minimum stress arrangement. It is inherent that such cabling of components 12 would impart some stress to the cables that will affect assembly 10 during dynamic application, but this basic cabling twist is required for basic cable construction to allow bending of the cable at all. However, if one side of assembly 10, after jacketing, is held in place and the other side is further twisted then this would put a cast or extra strain on components 12.

To prevent this extra stress or cast, a lay line 20 is added to cable jacket 16. As noted above lay line 20 shows the least stress alignment of the cabled internal cable components. If the lay line is straight during and after installation then it is known that the internal components are likewise in a "straight" (or straightest) arrangement, and have the least possible pre-tensioned alignment.

Figure 6:
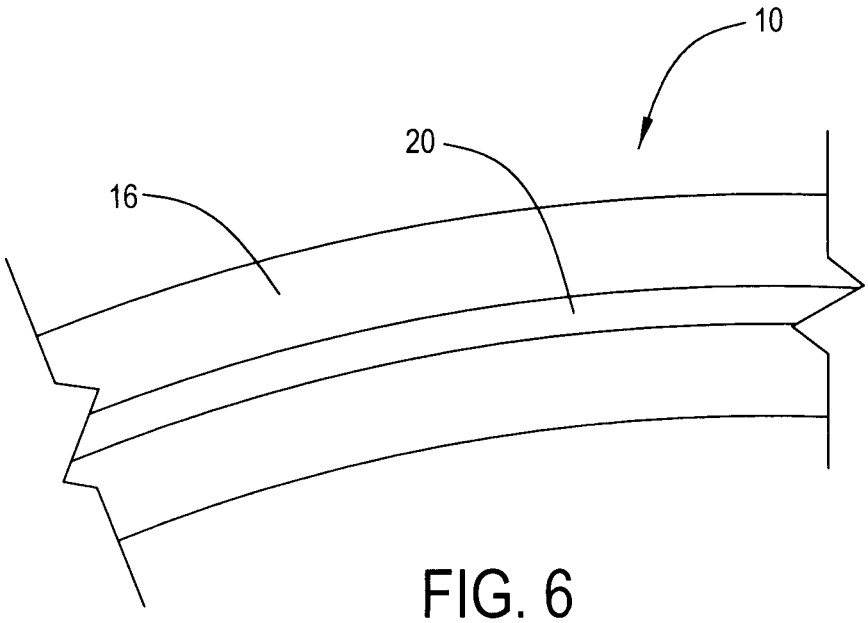
FIG. 6 shows a top drive service loop cable assembly having an embedded lay line in accordance with one embodiment.

Unlike the prior art printed lay-lines, this lay line 20 is embedded within cable jacket 16 as shown in FIG. 6 as a recessed embossed line.

Jacket 16 of assembly 10 is typically made from Chlorinated Polyethylene (CPE), but it can also be Thermoplastic polyurethane (TPU) or other such materials suitable for top drive heavy equipment applications.

In one arrangement lay line 20 may simply be a recessed cavity or embossed line, offset and impressed into from the full jacket diameter and/or it may include pressed text taking the place of the printed text of the prior art (e.g. "AMER-CABLE GEXOL-125 (YEAR) 777-3/C 2 KV POWER SERVICE LOOP").

To form lay line 20, a marker tape (not shown) is produced by using alphanumeric dies to imprint a blank nylon tape (e.g. 0.019"×0.375") with the appropriate information. This imprinted nylon tape is then fed through a release agent and pulled into the back of a mold extruder which presses it into the uncured rubber of cable jacket 16 during extrusion. The molded assembly 10 and jacket 16 is then subject to vulcanization (to cure the jacket) after which the mold and nylon tape are stripped away leaving the lay line 20 and markings permanently imbedded into cable jacket 16 as shown in FIG. 6. As shown in FIG. 6, lay line 20 is about 0.019" deep (the thickness of the nylon tape) and 0.375" wide (the width of the nylon tape). It is noted that lay line 20 is shown on one side of assembly 10 but may be put on one side of cable assembly 10 or it can be included on two opposing sides for convenience of viewing.

Figure 7:
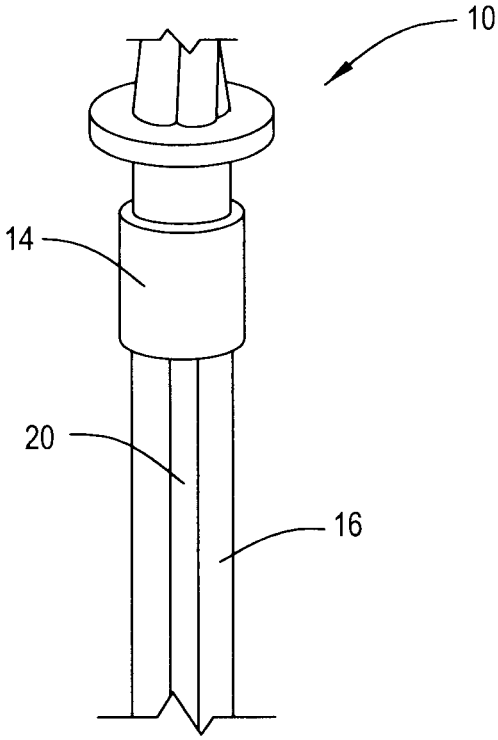
FIG. 7 shows a top drive service loop cable assembly with a connected flange, having an embedded lay line with connected flange in accordance with one embodiment.
Figure 8:
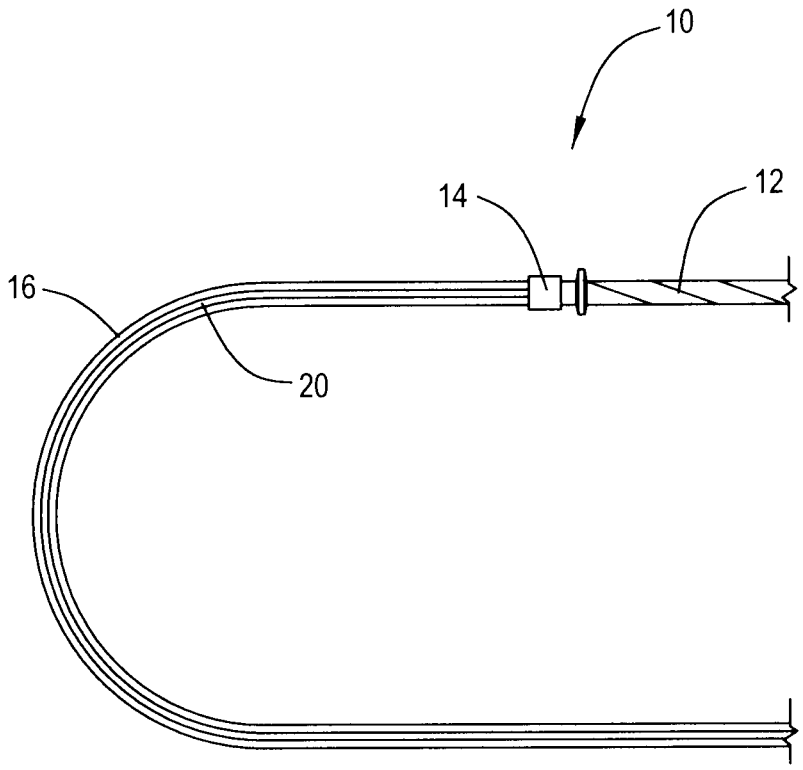
FIG. 8 shows a top drive service loop cable assembly with a connected flange, having an embedded lay line with connected flange in accordance with one embodiment.

As shown in FIGS. 7 and 8, cable assembly 10 is shown with full jacket 16, lay line 20, flange 14 (with cable components 12 exposed on the other side of flange 14). FIG. 8 shows a longer view assembly 10. As seen in the figures, lay line 20 is consistent and non-twisted over the length of assembly. Thus, when coupling flange 14 on one side of an oil derrick platform and the other flange 14 to the drive equipment, the installer can ensure that lay line 20 remains straight as best shown in FIG. 8 so that there is no additional "cast" or torsional strain on internal cables 12 of assembly 10. Moreover, as lay line 20 is embedded and permanent during continued dynamic application cycles lay line 20 will remain, and not rub-off. As a result if the cable is detached, e.g. for maintenance, movement, re-use and the like, when re-attached, it will remain available for the installer/technicalities to properly install a second time and so on.

While only certain features of the invention have been illustrated, and described herein, many modifications, substitutions, changes or equivalents will now occur to those skilled in the art. It is therefore, to be understood that this application is intended to cover all such modifications and changes that fall within the true spirit of the invention.

The invention claimed is:

1. A top drive service loop cable assembly comprising:

a plurality of cabled internal cable components;

a jacket covering said internal cable components;

a flange connected to said jacket and supporting said internal cable components, wherein said jacket has a recessed embedded lay line embossed into said cable and aligned with internal cable components, wherein said recessed embedded lay line is impressed into uncured rubber of said jacket with a nylon tape coated with a release agent which is impressed into said uncured rubber via a mold extruder, during extrusion, and wherein said jacket is vulcanized and then said nylon tape is removed, leaving said embossed and recessed embedded lay line in said jacket.

2. The top drive service loop cable assembly as claimed in claim 1, wherein said embedded lay line is a recessed embossed area.

3. The top drive service loop cable assembly as claimed in claim 2, wherein said embedded lay line is a recessed embossed area that is 0.019" deep and 0.375" wide.

4. The top drive service loop cable assembly as claimed in claim 1, wherein said jacket is made from either one of Chlorinated Polyethylene (CPE) or Thermoplastic polyurethane (TPU).

* * * * *